United States Patent [19]

Fesler

[11] Patent Number: 4,516,616

[45] Date of Patent: May 14, 1985

[54] PORTABLE TOWEL ACCESSORY

[76] Inventor: Ethel L. Fesler, 15129 SE. 141st Pl., Renton, Wash. 98056

[21] Appl. No.: 573,595

[22] Filed: Jan. 25, 1984

Related U.S. Application Data

[63] Continuation of Ser. No. 365,534, Apr. 5, 1982, abandoned.

[51] Int. Cl.[3] ..... A47K 10/12; A63B 57/00; A63B 47/04

[52] U.S. Cl. ..... 150/52 R; 15/21 A; 15/209 R; 206/315.9

[58] Field of Search ..... 150/52 R, 52 G; 224/253, 274; 273/32 R, 32 B, DIG. 19; 15/21 A, 209 R, 247; 206/315.3, 315.9, 812

[56] References Cited

U.S. PATENT DOCUMENTS

| | | | |
|---|---|---|---|
| 659,164 | 10/1900 | Born . | |
| 1,478,112 | 12/1923 | Flather | 15/209 R |
| 1,548,272 | 8/1925 | Larrence . | |
| 1,873,503 | 8/1932 | Stewart | 15/209 R |
| 2,221,305 | 11/1940 | Chase | 15/209 R |
| 2,803,845 | 8/1957 | Bradford | 15/209 R |
| 3,159,281 | 12/1964 | Hutter et al. | 211/45 |
| 3,350,736 | 11/1967 | Frazelle et al. | 150/52 R X |
| 3,406,658 | 10/1968 | Neugart | 15/209 R X |
| 3,585,693 | 6/1971 | Barnhardt | 224/274 X |
| 3,660,861 | 5/1972 | Delmonico | 15/209 R |
| 3,662,803 | 5/1972 | Kuvik | 150/52 R |
| 3,755,858 | 9/1973 | McPhaul | 224/253 X |
| 3,938,570 | 2/1976 | Stewart | 150/52 |
| 4,101,026 | 7/1978 | Bonk | 206/205 |

FOREIGN PATENT DOCUMENTS

| | | | |
|---|---|---|---|
| 8536 | of 1905 | United Kingdom | 15/21 A |
| 7955 | of 1915 | United Kingdom | 15/21 A |
| 207370 | 11/1923 | United Kingdom | 150/1.5 R |

*Primary Examiner*—William Price
*Assistant Examiner*—Sue A. Weaver
*Attorney, Agent, or Firm*—Delbert J. Barnard; Joan H. Pauly

[57] ABSTRACT

A cover (6) for a towel (4) comprises a sheet of water-resistant or waterproof material. Carrying means are provided for carrying the accessory (2) with the towel (4) inside the cover (6) and substantially surrounded by the cover (6) except at the underside of the accessory (2). Connecting means are also provided for detachably connecting a localized portion of the towel (4) to the cover (6). The carrying and connecting functions may be performed by the same member or members. For example, in a preferred embodiment an openable loop (14) passes through first and second holes (12) in the cover (6) and first and second openings (16) in the towel (4). A loop (14) so attached to the towel (4) and cover (6) also provides the preferred feature of reversing means for carrying the accessory (2) with the cover (6) inside the towel (4) and at least an upper portion of the cover (6) substantially surrounded by the towel (4). Reversing means may also be separately provided. The accessory (2) may be designed to be used with an ordinary unmodified towel, or it may be designed to be used with a modified towel (4).

12 Claims, 13 Drawing Figures

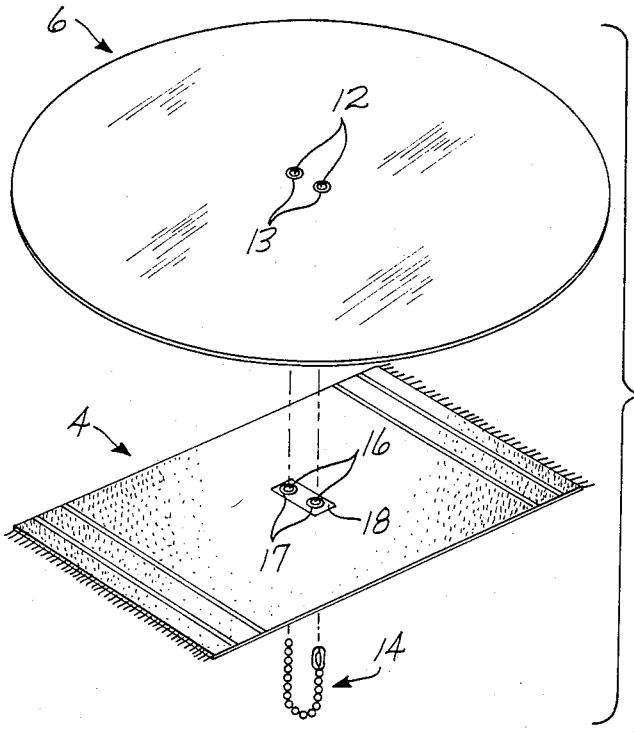
Fig. 4
Fig. 5
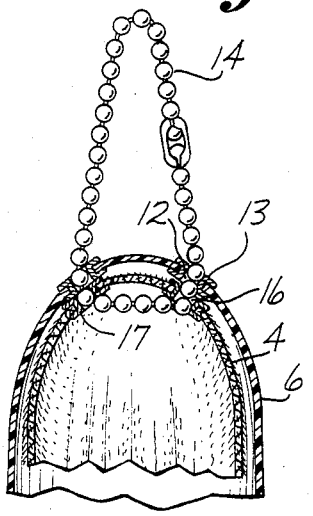
Fig. 7
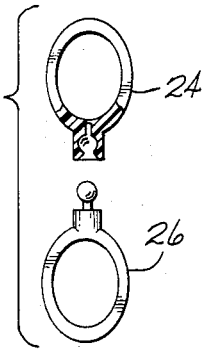
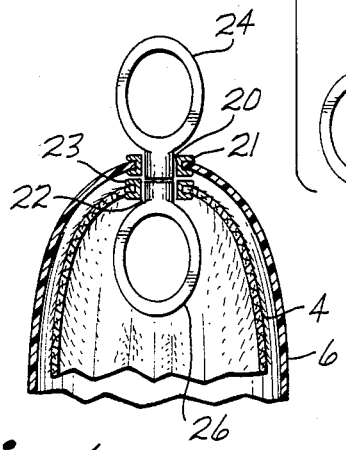
Fig. 6
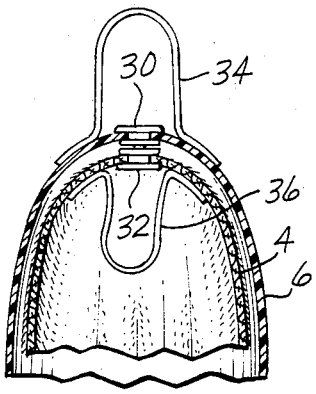
Fig. 8

PORTABLE TOWEL ACCESSORY

This application is a continuation of application Ser. No. 365,534, filed Apr. 5, 1982, abandoned.

TECHNICAL FIELD

This invention relates to portable towel accessories and, more particularly, to an accessory that is easily carried or hung on a support member, that has a cover to protect a towel from dirt and moisture and to protect clothing and other articles from contact with a used towel, and that provides easy and quick access to the towel inside the cover.

BACKGROUND ART

There are many situations in which it is desirable to have a towel readily available but in which it is difficult to protect the towel from getting wet or soiled. Such situations include golfing, fishing, bowling, and working in a machine shop.

On the golf course, a towel can easily become soaked by rain, whether expected or unexpected. Unfortunately, on rainy days the need for a towel on the golf course is usually greater than the need on sunny days. Therefore, just when a golfer needs a towel most to dry his clubs or the golf ball, any towel that might be available is likely to be too wet to be of any use. A similar situation prevails in relation to fishing, especially fishing from a moving boat. Just when the need for a towel is the greatest, that is when the spray is the heaviest, the available towels tend to be their wettest.

Bowlers also have a regular need for a clean and dry towel since it is very important that their hands be clean and dry in order to prevent the bowling ball from slipping accidently out of their grip. Although rain showers or spraying water are generally not a problem in a bowling alley, it is usually difficult to find a clean place to put a towel where the towel will not be likely to become soiled.

In machine shops and other work areas, a towel is frequently needed for wiping hands or tools or other objects. However, in such work areas there is also frequently a lot of dust flying around. This dust tends to settle on everything in the work area, including any towels that might be exposed to the dust. Moreover, if a towel is used to wipe grease or other dirt from an object, the towel will tend to in turn soil any surface with which it comes in contact. In addition, an ordinary towel has no special means for carrying or hanging the towel, and ordinary towel holders are not portable.

In each of the above situations and in similar situations, it is also difficult to protect clothing and other items from coming into contact with a used towel. Such contact tends to transfer moisture and dirt from the towel to the clothing or other item.

The applicant is unaware of any commercially available accessories or of any accessories disclosed in the patent literature that perform the functions performed by the portable towel accessory of the present invention or that have more than superficial resemblance to the accessory of the present invention. However, the patent discussed below may be of interest in connection with the present invention.

U.S. Pat. No. 3,938,570, granted Feb. 17, 1976, to Edra J. Stewart, discloses a dual purpose golf club head cover. The cover protects the golf club head and additionally has a towel-like skirt that can be used for wiping a ball, a club, or hands. The cover itself, including the skirt, is not protected from rain or dirt. The cover is generally carried by placing it over a golf club head, and the cover is apparently not intended to be carried separately from the golf club.

DISCLOSURE OF THE INVENTION

The subject of this invention is a portable towel accessory. According to a basic aspect of the invention, an accessory for use with a towel comprises a cover for the towel and carrying and connecting means. The cover comprises a sheet of at least water-resistant material. The carrying and connecting means are for detachably connecting a localized portion of the towel to the cover and for carrying the accessory with the towel inside the cover and substantially surrounded by the cover except at the underside of the accessory. Preferably, the accessory further includes reversing means for carrying the accessory with the cover inside the towel and at least an upper portion of the cover substantially surrounded by the towel.

According to another basic aspect of the invention, an accessory for use with a towel comprises a cover for the towel, connector means, and carrying means. The cover comprises a sheet of at least water-resistant material. The connector means is for detachably connecting a localized portion of the towel to the cover. The carrying means is for carrying the accessory with the towel inside the cover and substantially surrounded by the cover except at the underside of the accessory.

According to still another basic aspect of the invention, the towel accessory comprises a towel and a cover for the towel comprising a sheet of at least water-resistant material. The accessory also includes carrying and connecting means for detachably connecting a localized portion of the towel to the cover and for carrying the accessory with the towel inside the cover and substantially surrounded by the cover except at the underside of the accessory. Preferably, the carrying and connecting means includes means for carrying the accessory with the cover inside the towel and at least an upper portion of the cover substantially surrounded by the towel.

According to a preferred aspect of the invention, the carrying and connecting means comprises first and second openings in the towel, first and second holes in the cover, and an openable loop passing in turn through said first hole, said first opening, said second opening, and said second hole. The holes are aligned with the first and second openings, respectively.

According to another aspect of the invention, the carrying and connecting means includes an elastic member to permit the towel, when the towel is inside the cover, to be pulled elastically away from the cover a distance sufficient to allow use of the towel without lifting the cover.

According to yet another basic aspect of the invention, the towel accessory comprises a towel and a cover for the towel comprising a sheet of at least water-resistant material. The accessory also includes connector means for detachably connecting a localized portion of the towel to the cover, and carrying means for carrying the accessory with the towel inside the cover and substantially surrounded by the cover except at the underside of the accessory. Preferably, the accessory further includes reversing means for carrying the accessory with the cover inside the towel and at least an upper portion of the cover substantially surrounded by the towel.

The accessory of this invention has many advantages. It is easily carried by hand or by hanging it on a portable carrier, such as a golf bag that is provided with wheels. It can also be hung from a permanent structure. While the towel is being carried or is hanging from a structure, the towel is protected from getting wet or dirty because it is substantially surrounded by the cover. The towel is easily and quickly accessible even when covered by the cover because the accessory is open at its underside. In the preferred embodiments that include reversing means, the accessory may also be carried or hung with the cover inside the towel, if desired. When the towel is inside the cover, not only is the towel protected from dirt and moisture in the environment, but clothing and other objects that come into contact with the accessory are also protected from coming into contact with a used towel. Since the towel is removably attached to the cover, the towel may be detached for washing or for the purpose of changing the towel when a different type, size, or color towel is desired. The accessory of this invention is very versatile and is highly useful in any of the variety of situations described above or in any of the countless similar situations in which a towel is needed.

These and other advantages and features will become apparent from the detailed description of the best modes for carrying out the invention that follows.

BRIEF DESCRIPTION OF THE DRAWINGS

In the drawings, like element designations refer to like parts throughout, and:

FIG. 4 is an exploded pictorial view showing the accessory of FIGS. 1–3.

FIG. 5 is a fragmentary elevational view of the upper portion of the embodiment of the accessory shown in FIGS. 1–4, with portions of the accessory shown in elevation and other portions shown in section.

FIG. 6 is a view similar to FIG. 5, except that a different embodiment of the accessory is shown.

FIG. 7 is an elevational view of the carrying and connecting means of the embodiment of the accessory shown in FIG. 6, with the carrying and connecting means shown in a detached position and with portions of the upper member shown in section.

FIG. 8 is a view similar to FIGS. 5 and 6, except that it shows another embodiment of the invention.

BEST MODES FOR CARRYING OUT THE INVENTION

Figure 1:
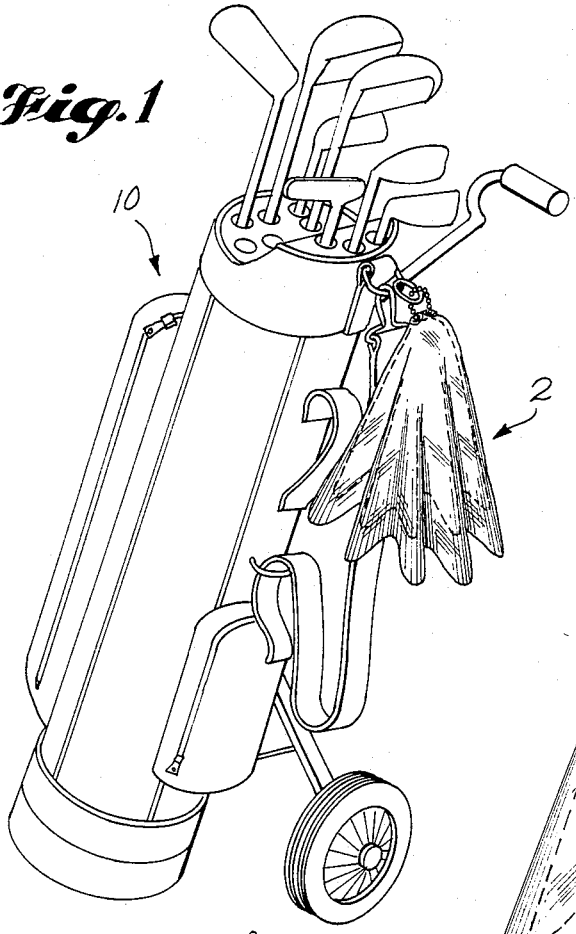
FIG. 1 is a pictorial view of a wheeled golf bag on which a first preferred embodiment of the accessory of this invention is hung.
Figure 2:
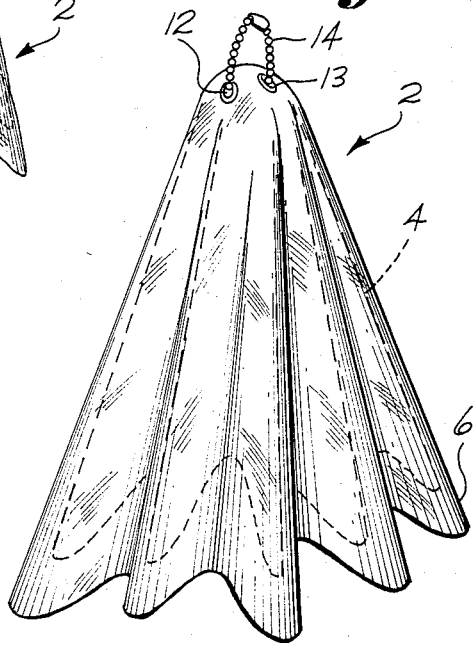
FIG. 2 is a pictorial view of the accessory shown in FIG. 1, with the towel inside the cover.

The drawings show various preferred embodiments of a towel accessory 2 that are constructed according to the invention and that also constitute the best modes of the invention currently known to the applicant. The accessory 2 is designed to be used in any of a variety of situations, such as those discussed above. The accessory 2 is shown in FIG. 1 in connection with a golf bag 10 for illustrative purposes only, and the illustration of this particular use is not intended to in any way limit the scope of the invention or the scope of the uses of the invention.

Each of the embodiments of the towel accessory 2 of this invention shown in the drawings includes a cover 6 for the towel 4 that comprises a sheet of at least water-resistant material. In some of the embodiments, namely those shown in FIGS. 11–13, the accessory 2 is designed to be used with an ordinary towel 4. In the embodiments shown in FIGS. 1–10, the towel 4 has been modified to interact with the other parts of the accessory 2.

Each of the embodiments shown in the drawings also includes carrying and connecting means for detachably connecting a localized portion of the towel 4 to a localized portion of the cover 6 and for carrying the accessory 2 with the accessory 2 open at the underside, with the cover and the towel each having substantially the shape of a pleated cone, and with the towel 4 inside the cover 6 and substantially surrounded by the cover 6 except at the underside of the accessory 2. This carrying and connecting means may be provided in the form of one or more members that cooperate to perform both the carrying and the connecting functions, such as in the embodiments shown in FIGS. 1–5, 6 and 7, 9, 10, 12, and 13. In these embodiments, both the cover 6 and the towel 4 hang freely from the carrying and connecting means, as shown in the drawings. The carrying and connecting means may also be provided separately in the form of two separate members or groups of cooperating members, one that performs the carrying function and one that performs the connecting function. Examples of embodiments of the towel accessory 2 with separate carrying means and connecting means are shown in FIGS. 8 and 11. In these embodiments, the cover 6 hangs freely from the carrying means and the towel 4 hangs freely from the connector means. (See FIGS. 8 and 11.) In all the embodiments shown in the drawings, the carrying and connecting arrangement provides quick and easy access to the towel when the towel is so surrounded by the cover.

It is generally preferable to provide the accessory 2 with reversing means for carrying the accessory 2 with the cover 6 inside the towel 4 and at least an upper portion of the cover 6 substantially surrounded by the towel 4. The reversing function may be performed by the same member or members that perform the carrying and connecting functions, such as in the embodiments shown in FIGS. 1–5, 6 and 7, and 13. The reversing means may also be a separate member, such as in the embodiments shown in FIGS. 8, 9, 10, and 12.

The towel accessory 2 shown in FIGS. 1–5 is the first preferred embodiment of the accessory of this invention. The accessory 2 includes a towel 4, a cover 6, and carrying and connecting means, as described above. This embodiment of the accessory 2 also includes reversing means so that the accessory 2 can be carried with the cover 6 inside the towel 4. In this preferred embodiment, the reversing means is part of the carrying and connecting means, and one member, in cooperation with openings 16 in the towel 4 and holes 12 in the cover 6, performs all three functions. In other words, basically one member provides the means for carrying the accessory 2 with the towel 4 inside the cover 6, for carrying the accessory 2 with the cover 6 inside the towel 4, and for connecting the towel 4 to the cover 6. The member that performs these three functions is the openable chain 14. The chain 14 is of a common type that has varied uses such as hanging a rabbit's foot or puzzle cube from a belt. The chain 14 consists of a number of small metal balls that are linked together and a connecting piece that frictionally grips the small metal ball at each end of the chain.

The carrying and connecting means of the embodiment shown in FIGS. 1–5 comprises an openable loop (the metal chain 14), first and second openings 16 in the towel 4, and first and second holes 12 in the cover 6. The holes 12 in the cover 6 are aligned with the first and second openings 16 in the towel 4, respectively. The chain 14 passes in turn through the first hole 12 in the cover 6, the first opening 16 in the towel 4, the second opening 16 in the towel 4, and the second hole 12 in the cover 6. Thus, the chain 14 holds the towel 4 and the cover 6 together and can be pulled to form a loop on either side of the accessory 2, that is on the cover side or on the towel side of the accessory 2. In order to reverse the accessory 2, the accessory 2 need only be turned inside out and the chain 14 pulled to the then outside portion of the accessory 2.

The cover 6 is preferably sized so that a towel 4 the size of an ordinary hand towel will be substantially surrounded by the cover 6 except at the underside of the accessory 2 when the towel 4 is inside the cover 6 and so that the greater part of the cover 6, comprising an upper portion of the cover 6, will be substantially surrounded by the towel 4 when the cover 6 is inside the towel 4. Of course, a towel accessory made according to the invention could be sized to accommodate a different sized towel, according to individual taste or the needs of a particular situation. The hand towel size is merely the preferred and most commonly desired size.

Figure 3:
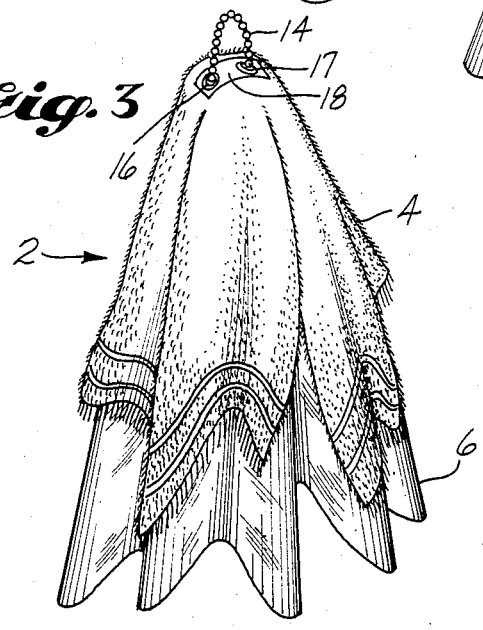
FIG. 3 is a view similar to FIG. 2, except that the cover is inside the towel.

It is also preferable to provide reinforcement around the holes 12 and openings 16 in the cover 6 and towel 4 in order to prevent the cover 6 from ripping and the towel 4 from raveling or ripping. One way in which such reinforcement can be provided is shown in FIGS. 1–5. This consists of simply providing small metal eyelets 13, 17 around each hole 12 and each opening 16. These eyelets 13, 17 may be of the type commonly found in various goods made of fabrics or other sheet material. As best shown in FIG. 3, the towel 4 in the accessory 2 of the first preferred embodiment is provided with additional reinforcing means in the form of a strip 18 of stretch and tear resistant cloth. This cloth strip 18 is sewed onto the towel 4 in the region of the openings 16, which extend through the towel 4 and the strip 18.

FIGS. 6 and 7 show another preferred embodiment of the accessory of this invention. Like the embodiment shown in FIGS. 1–5, this embodiment also includes essentially one member that performs the three functions of carrying the accessory 2 with the towel 4 inside the cover 6, carrying the accessory 2 with the cover 6 inside the towel 4, and connecting the cover 6 to the towel 4. In this embodiment, the carrying and connecting means comprises an opening 22 in the towel 4, a hole 20 in the cover 6, and first and second loops 24, 26.

Each of the loops 24, 26 has a projecting member, each of which projects through the hole 20 in the cover 6 and the opening 22 in the towel 4, respectively. The projecting members then detachably engage each other. In this embodiment, the loops 24, 26 and the projecting members are preferably made of molded plastic. As shown in FIG. 7, one of the loops 26 has a projecting member that includes a small shaft at the outer end of which is a plastic ball. The other loop 24 has a projecting member that includes a ball-shaped chamber that communicates with the outer end of the projecting member by means of a passsageway that increases in width toward the outer end. The ball on the projecting member of loop 26 snaps into the ball-shaped chamber in the projecting member of the loop 24.

When the accessory 2 is positioned with the towel 4 inside the cover 6, the loop 24 projects outwardly from the outside surface of the cover 6 and the loop 26 projects inwardly inside the towel 4 and the cover 6 from the inside surface of the towel 4. In order to reverse the accessory 2, the towel 4 and the cover 6 need only be flipped inside out and then the loop 26 will project outwardly from the outside surface of the towel 4 and the loop 24 will project inwardly from the inside surface of the cover 6.

As in the embodiment shown in FIGS. 1–5, it is preferable to provide reinforcement around the hole 20 in the cover 6 and the opening 22 in the towel 4. One way of providing such reinforcement is illustrated in FIG. 6. Small metal eyelets 21, 23 are provided around the hole 20 and the opening 22, respectively, just as similar eyelets are provided in the embodiment shown in FIGS. 1–5.

FIG. 8 shows another preferred embodiment of the invention in which the three functions described above are each performed by a separate member or members. In this embodiment, the connector means comprises a snap member 32 attached to the localized portion of the towel 4, and a complimentary snap member 30 attached to the cover 6. The snap members 30, 32 snap together to attach the towel 4 to the cover 6. As in all of the preferred embodiments, it is preferable that the towel 4 and cover 6 be attached to each other at approximately the center of area of each.

In the embodiment shown in FIG. 8, the separate carrying means comprises a loop 34 attached to the cover 6 substantially opposite the complimentary snap member 30. In other words, the loop 34 extends outwardly from the outer surface of the cover 6 essentially above the point at which the complimentary snap member 30 is attached. The loop 34 may be made from any durable material, such as a closely woven fabric.

The embodiment shown in FIG. 8 also includes separate reversing means for carrying the accessory 2 with the cover 6 inside the towel 4 so that at least an upper portion of the cover 6 is substantially surrounded by the towel 4. This reversing means comprises a loop 36 attached to the towel 4 substantially opposite the localized portion of the towel 4 which is attached to the cover 6. This loop 36 would generally be made from the same material as the loop 34.

Figure 9:
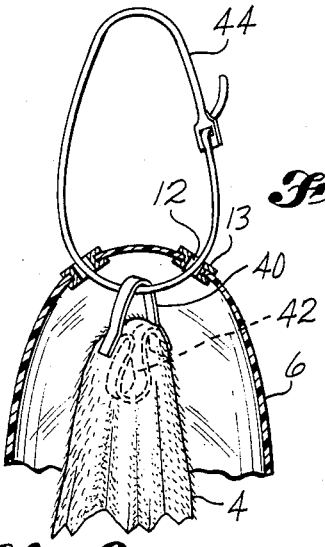
FIG. 9 is a view similar to FIGS. 5, 6, and 8, except that it shows still another embodiment of the invention.
Figure 10:
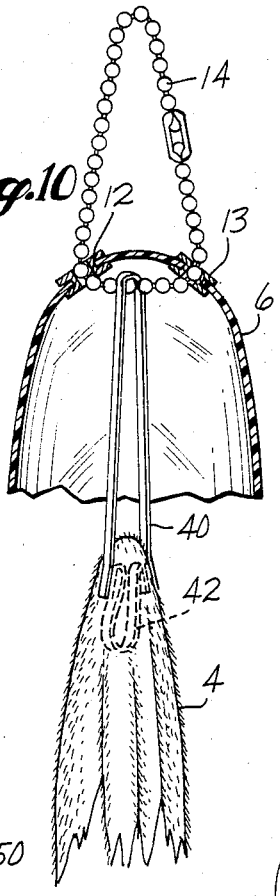
FIG. 10 is a view similar to FIGS. 5, 6, 8, and 9, except that a different embodiment of the invention is shown, which embodiment includes an elasticized connecting member shown in a stretched condition.
Figure 11:
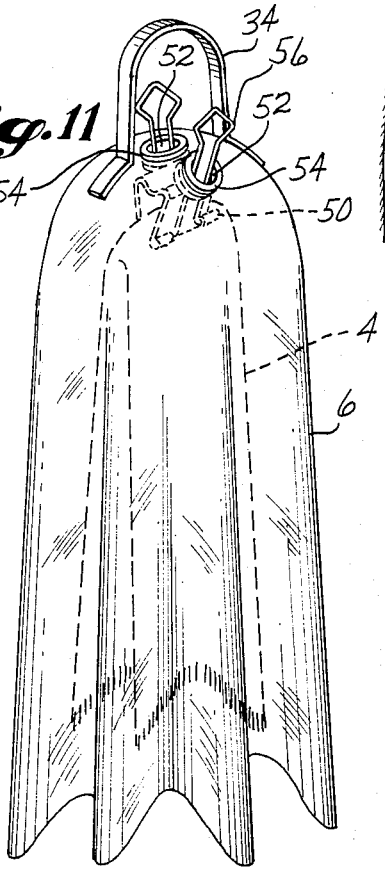
FIG. 11 is a pictorial view of yet another embodiment of the invention.

FIGS. 9 and 10 show two other preferred embodiments in which the cover 6 for the towel 4 is constructed in the same manner as the cover 6 in the embodiment shown in FIGS. 1–5. However, in these embodiments there are no openings in the towel 4, and therefore, the carrying and connecting means of the embodiment in FIGS. 1–5 is correspondingly modified. In the embodiments of FIGS. 9 and 10, the carrying and connecting means comprises a connector loop 40 attached to the localized portion of the towel 4 which is attached to the cover 6, first and second holes 12 in the cover 6, and an openable loop 44, 14 that passes in turn through the first hole 12 in the cover 6, the connector loop 40, and the second hole 12 in the cover 6. The openable loop 44, 14 may be formed by a chain 14, as it is in FIGS. 1–5 and FIG. 10, or by some other flexible openable loop, such as the plastic loop 44 shown in FIG. 9. The plastic loop 44 shown in FIG. 9 is provided with a belt-like connection so that the loop 44 may be opened and closed. The connector loop 40 that is attached to the towel 4 is similar to, but preferably smaller than, the loops 34, 36 of the embodiment shown in FIG. 8.

In order to make the accessories of FIG. 9 and FIG. 10 reversible, it is preferable to provide them with a loop 42 for carrying the accessory 2 with the cover 6 inside the towel 4. This loop 42 may be attached to the towel 4 on the inside surface of the towel 4 substantially opposite the connector loop 40. It is generally preferable for the loop 42 to be made from the same material as the loop 40. However, the loop 40 would preferably be of a different material in accessories that include the additional feature of having an elastic member that permits the towel 4, when the towel 4 is inside the cover 6, to be pulled elastically away from the cover 6 a distance sufficient to allow use of the towel 4 without lifting the cover 6. This elastic feature is illustrated in FIG. 10 in which the connector loop 40 of the carrying and connecting means is made from an elasticized material. FIG. 10 shows the accessory 2 with the towel 4 pulled elastically away from the cover 6 and in position for use.

As noted above, FIGS. 11–13 show embodiments of the accessory of the invention designed to be used with an ordinary unmodified towel. The embodiment shown in FIG. 11 has separate connector means and carrying means. In this embodiment, the cover 6 has an inner surface and an outer surface, the connector means comprises a clamp 50 attached to a central portion of the inner surface of the cover 6, and the carrying means comprises a loop 34 attached to the outer surface of the cover 6 essentially opposite the clamp 50. The loop 34 is similar to the loop 34 of the embodiment shown in FIG. 8.

The clamp 50 may be attached to the cover 6 in a variety of ways. FIG. 11 illustrates only one such way. In FIG. 11, the clamp 50 has two upwardly projecting members 56 that project upwardly and outwardly through two holes 52 in the cover 6. Surrounding each hole 52 is an annular member 54 that grips the projecting member 56. The annular members 54 also reinforce the holes 52. This arrangement provides the additional advantage of making the towel 4 detachable without lifting the cover 6. To detach the towel 4 from the cover 6, all that is necessary is to squeeze the two projecting members 56 together.

The connector means shown in FIG. 11 does not include reversing means, and the embodiment as illustrated is not reversible. However, this embodiment could be used with a modified towel 4, such as a towel 4 having a loop 42 as shown in FIG. 9, and the accessory 2 with the modified towel would than be reversible.

Figure 13:
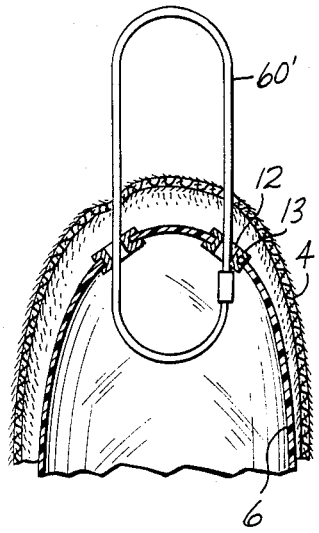
FIG. 13 is similar to FIG. 12, except that a different embodiment of the invention is shown.
Figure 12:
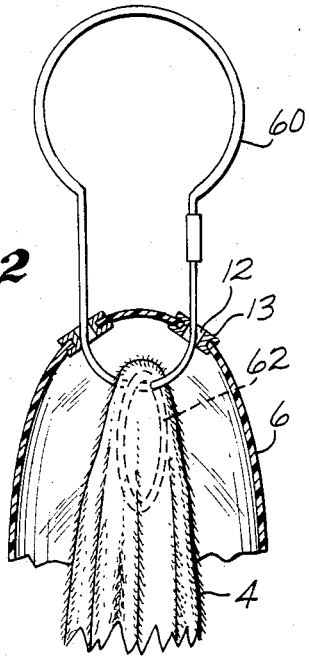
FIG. 12 is a view similar to FIGS. 5, 6, 8, 9, and 10, except that a different embodiment of the invention is shown.

The embodiments of the invention shown in FIGS. 12 and 13 include carrying and connecting means comprised of first and second holes 12 in the cover 6 (similar to the holes 12 in the cover 6 in the embodiment shown in FIGS. 1–5) and an openable loop 60, 60′. The openable loop 60, 60′ includes safety pin means for fastening the loop 60, 60′ to the towel 4. The loop 60, 60′ also passes through the first and second holes 12 in the cover 6. In these embodiments, the openable loop 60, 60′ is preferably made at least partially from metal with a thin portion with a sharp pointed end. This thin portion, combined with the other end of the loop 60, 60′ which preferably includes a closing mechanism similar to that found on safety pins, comprise the safety pin means. In other words, the two ends of the loop 60, 60′ that attach and detach from each other resemble a safety pin with a sharp pointed end that may be hooked through the towel 4.

FIGS. 12 and 13 show two ways in which an accessory 2 with carrying and connecting means that includes safety pin means may be made reversible. In FIG. 12, the reversing means is simply a reversing loop 62 carried by the safety pin means. To reversibly attach the towel 4 to the cover 6, the pointed end of the carrying and connecting means is passed in turn through the first hole 12 in the cover 6, one thickness of the towel 4, the reversing loop 62, another thickness of the towel 4, and finally the second hole 12 in the cover 6. The loop 60 is then closed like a safety pin and the accessory 2 is ready for use.

In the embodiment shown in FIG. 13, the one loop 60′ which includes the safety pin means performs all three functions discussed above. In this embodiment, an arcuate portion of the safety pin means provides a reversing means for carrying the accessory with the cover 6 inside the towel 4. As can be seen in FIG. 13, the loop 60′ is essentially oblong in shape with straight sides and rounded ends. The loop 60′ may be pulled back and forth through the cover 6 and the towel 4 so that a carrying loop is provided adjacent to the cover 6 or adjacent to the towel 4, as desired.

In each of the embodiments shown in the drawings, the various parts of the accessory 2 may be made from a variety of materials. Preferably, the cover 6 is made of waterproof plastic. Such plastic would provide a cover 6 that is both waterproof and dirt-proof. The plastic used might be see-through clear plastic, clear plastic with a design on it, or a colored plastic with or without a design. The towel 4 would generally be made from terry cloth. The color schemes of the towel 4 and the cover 6 could be coordinated with each other in accordance with the tastes or needs of the user. The carrying and connecting means can also be constructed from a variety of materials, such as those mentioned above or other appropriate materials. For example, the snaps 30, 32 shown in FIG. 8 could be replaced by two interlocking strips forming a fastener, such as those sold under the trademark Velcro, in which one such strip has outwardly extending hooked filaments that engage a pile surface on the other strip.

It can be seen that the towel accessory 2 of this invention is very versatile, both in the materials from which it may be made and in the variety of situations in which it may be used. This versatility is enhanced by the complete portability of the accessory 2. Any of the illustrated embodiments may be easily carried by hand or hung on a hook or peg-like member. Those embodiments with an openable carrying loop may also be hung from a closed member, such as a ring. Therefore, the accessory 2 may be kept accessible and ready for use in almost any situation.

To illustrate the versatility of a particular embodiment of the towel accessory 2 in a particular situation, it is useful to look at the use of the embodiment shown in FIGS. 1–5 while golfing. On the golf course, the accessory 2 may be attached to a belt to be carried around on the person. It may also be attached to a loop on a golf bag 10, as shown in FIG. 1. In either case, the fact that the carrying loop 14 is openable is particularly useful since the loop 14 can be opened and threaded through a ring or belt loop and then closed for carrying. On the golf course, the accessory 2 might also be draped over the top of a golf bag 10, such as the one shown in FIG. 1, with the towel 4 underneath the cover 6. In this position, the cover 6 would not only protect the towel 4 from moisture and dirt but also would protect the golf clubs from getting wet in the event of a rain shower. In each of these situations, the towel 4 is in a position of ready accessability and will be clean and dry when the user needs it.

Although the preferred embodiments of this invention have been illustrated and described, it is to be understood that various modifications may be made without departing from the spirit and scope of the present invention as defined in the following claims.

What is claimed is:

1. In combination:

a fabric hand towel having a central portion;

a towel cover constructed from a sheet of a material which is at least water-resistant, said towel cover being a separate member from said towel and having a central portion;

connector means detachably connecting together the central portions of the towel and towel cover; and carrying means connected so that, in use, the towel and towel cover are suspended from the carrying means and said towel and cover each hang freely from said means and each assume the shape of a pleated cone, with the central portions of the towel and cover forming apexes of the cones, whereby the combination may be carried with the towel cover over the towel, and access to the towel may be simply had by a user bringing his or her hands upwardly to the towel, and wherein the connector means permits movement of the towel and towel cover between a first position in which the towel cover is draped over the towel and a second position in which the towel is draped over the towel cover, and wherein in each position the carrying means presents an upwardly directed handle portion and in each position the towel cover and towel hang freely from said carrying means.

2. The combination of claim 1, wherein:

the connector means comprises first and second spaced apart openings in said central portion of the towel; first and second spaced apart holes in said central portion of the cover, said holes being substantially alignable with the first and second openings in the towel; and a loop member that is substantially longer than the distance between the openings in the towel and the holes in the towel cover, said loop member having first and second ends, said loop member extending loosely through said first hole, then loosely through said first opening, then loosely through said second opening, then loosely through said second hole, and said loop member having means at the ends of said loop member for detachably connecting such ends together;

the carrying means comprises said loop member; and in use, the towel and towel cover are suspended from the loop member and said towel and cover each hang freely from said loop member and each assume the shape of a pleated cone.

3. The combination of claim 2, wherein when the towel and towel cover are in said first position, a portion of the loop member, extending between the first and second holes in the towel cover forms said handle portion and the towel and the towel cover rest on and are supported by a different portion of the loop member which extends between the two openings in the towel; and wherein when the towel and towel cover are in said second position, a portion of the loop member which extends between the two openings in the towel forms said handle portion and the towel and towel cover rest on and are supported by a different portion of the loop member which extends between the two holes in the towel cover.

4. The combination of claim 2, wherein the towel cover comprises a sheet of waterproof plastic material.

5. The combination of claim 3, wherein the towel cover comprises a sheet of waterproof plastic material.

6. The combination of claim 2, comprising a separate grommet in each hole and each opening.

7. In combination:

a fabric hand towel having a central portion;

a towel cover constructed from a sheet of a material which is at least water-resistant, said towel cover being separate from said towel and having a central portion; connector means detachably connecting together the central portions of the towel and towel cover; and carrying means connected so that in use the towel and towel cover are suspended from the carrying means and said towel and towel cover each hang freely from said means and each assume the shape of a pleated cone, with the central portions of the towel and towel cover forming apexes of the cones; and wherein the towel cover has an inner surface and an outer surface, the connector means comprises clamp means attached to the inner surface of said central portion of the towel cover; and the carrying means comprises a loop attached to the outer surface of the towel cover essentially opposite the clamp means.

8. In combination:

a fabric hand towel having a central portion;

a towel cover constructed from a sheet of a material which is at least water-resistant, said towel cover being separate from said towel and having a central portion;

carrying and connecting means detachably connecting together the central portions of the towel and towel cover such that in use the towel and towel cover are suspended from the carrying and connecting connector means and said towel and towel cover each hang freely from said means and each assume the shape of a pleated cone, with the central portions of the towel and towel cover forming apexes of the cones; and wherein the carrying and connecting means comprise an opening in the towel, a hole in the towel cover, and first and second loops, each of said loops having a projecting member, which projecting members project through said opening and said hole, respectively, and detachably engage each other.

9. In combination:

a fabric hand towel having a central portion;

a towel cover constructed from a sheet of a material which is at least water-resistant, said towel cover being separate from said towel and having a central portion;

carrying and connecting means detachably connecting together the central portions of the towel and towel cover such that, in use, the towel and cover are suspended from the carrying and connecting means and said towel and towel cover each hang freely from said means and each assume the shape of a pleated cone, with the central portions of the towel and cover forming apexes of the cones; and wherein the carrying and connecting means comprises a connector loop attached to said central portion of the towel, first and second holes in the towel cover, and an openable loop passing in turn through the first hole, the connector loop, and the second hole.

10. In combination:

a fabric hand towel having a central portion;

a towel cover constructed from a sheet of a material which is at least water-resistant, said towel cover being separate from said towel and having a central portion;

connector means detachably connecting together the central portions of the towel and towel cover;

carrying means connected so that, in use, the towel and towel cover are suspended from the carrying means and said towel and towel cover each hang freely from said means and each assume the shape of a pleated cone, with the central portions of the towel and cover forming apexes of the cones; and loop means for carrying the accessory with the towel cover inside the towel and at least an upper portion of the towel cover surrounded by the towel, said loop means comprising a loop attached to the central portion of the towel.

11. In combination:

a fabric hand towel having a central portion;

a towel cover constructed from a sheet of a material which is at least water-resistant, said towel cover being separate from said towel and having a central portion;

connector means detachably connecting together the central portions of the towel and towel cover; and carrying means connected so that, in use, the towel and towel cover are suspended from the carrying means and said towel and towel cover each hang freely from said means and each assume the shape of a pleated cone, with the central portions of the towel and cover forming apexes of the cones; and wherein the connector means comprises a snap member attached to said central portion of the towel, and a complementary snap member attached to said central portion of the cover, and said carrying means comprises a loop attached to the towel cover substantially opposite said complementary snap member.

12. A towel accessory as recited in claim 11, further comprising a loop attached to the towel substantially opposite said central portion, so that the towel and towel cover can be inverted, to place the towel over the cover, and the loop used as a carrying means.

* * * * *